US008657279B2

(12) United States Patent
Haupt-Terlau

(10) Patent No.: US 8,657,279 B2
(45) Date of Patent: Feb. 25, 2014

(54) NON-CIRCULAR SUCTION WHEEL AND SHEET FEEDER

(71) Applicant: Heidelberger Druckmaschinen AG, Heidelberg (DE)

(72) Inventor: Martin Haupt-Terlau, Erdmannhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/709,219

(22) Filed: Dec. 10, 2012

(65) Prior Publication Data

US 2013/0147109 A1 Jun. 13, 2013

(30) Foreign Application Priority Data

Dec. 8, 2011 (DE) ..... 10 2011 120 476

(51) Int. Cl.
*B65H 3/12* (2006.01)
*B65H 3/64* (2006.01)

(52) U.S. Cl.
USPC ..... 271/94; 271/112

(58) Field of Classification Search
USPC ..... 271/94, 119, 112
See application file for complete search history.

(56) References Cited

U.S. PATENT DOCUMENTS

| | | | | | |
|---|---|---|---|---|---|
| 1,707,209 | A * | 3/1929 | Broadmeyer | 271/96 |
| 3,990,696 | A * | 11/1976 | Landa | 271/94 |
| 5,028,043 | A * | 7/1991 | Karolyi | 271/14 |
| 5,630,583 | A * | 5/1997 | Yergenson | 271/119 |
| 7,552,919 | B2 * | 6/2009 | Lisena | 271/90 |
| 2010/0075821 | A1 | 3/2010 | Terlau | |

FOREIGN PATENT DOCUMENTS

| | | |
|---|---|---|
| DE | 520 229 | 3/1931 |
| DE | 520229 C | 3/1931 |
| DE | 196 32 657 C1 | 9/1997 |
| DE | 196 48 742 A1 | 5/1998 |
| DE | 10 2008 048 287 A1 | 3/2010 |

* cited by examiner

*Primary Examiner* — David H Bollinger
(74) *Attorney, Agent, or Firm* — Laurence A. Greenberg; Werner H. Stemer; Ralph E. Locher

(57) ABSTRACT

A suction wheel attracts sheets by suction and transports them. The suction wheel contains a suction wheel body rotatable about an axis of rotation and provided with a plurality of suction openings formed in the circumferential surface of the suction wheel body. Accordingly, the suction wheel body is of a non-circular shape. In particular, the suction wheel includes an attraction area for attracting a sheet, a retaining area for retaining and conveying a sheet, and a release area for releasing a sheet. A sheet feeder ideally incorporates such a suction wheel.

10 Claims, 7 Drawing Sheets

NON-CIRCULAR SUCTION WHEEL AND SHEET FEEDER

CROSS-REFERENCE TO RELATED APPLICATION

This application claims the priority, under 35 U.S.C. §119, of German application DE 10 2011 120 476.1, filed Dec. 8, 2011; the prior application is herewith incorporated by reference in its entirety.

BACKGROUND OF THE INVENTION

Field of the Invention

The invention relates to a suction wheel that has a suction wheel body rotatable about an axis of rotation and provided with a plurality of suction openings formed in its circumferential surface for attracting sheets by suction and transporting them. The invention further relates to a sheet feeder that includes such a suction wheel.

It has been known for a long time to separate sheets from a stack of sheets in a sheet feeder using suitable lifting and/or conveying devices such as suction elements and/or suction wheels. A respective first sheet is lifted off and separated from the stack, and the sheets are separately fed to a machine for processing sheets such as a sheet-fed folder. The sheets may be fed to the machine for processing sheets in a spaced-apart or an overlapping formation.

Published, non-prosecuted German patent application DE 10 2008 048 287 A1, corresponding to U.S. patent publication No. 20100075821, discloses a sheet feeder for a folder. In the area of the rear edge of a stack of sheets, the sheet feeder contains a suction element for lifting and separating sheets, and in the front area of the stack of sheets, the feeder contains a suction wheel. An adjustment of the position of the suction wheel permits one to modify the degree of overlap between the sheets that are transported over a downstream transport table to a downstream folder. The folding of overlapping sheets results in a greater throughput without a need to increase the sheet speed at an equal measure. This reduces the stress on the sheets and provides better quality of the folding process.

In suction wheels that are known in the art, there is a constant distance between the suction wheel and the upper edge of a stack of sheets from which the suction wheel is to remove the respective uppermost sheet. To ensure that the rotating suction wheel securely grips the respective uppermost sheet, the distance between the suction wheel and the upper edge of the stack may only be adjusted over a very small range, generally between four and six millimeters. The constant distance may cause disturbances in the suction process: if no separating air cushion is formed between the uppermost sheet and the sheet underneath the uppermost sheet and if thin types of paper are to be processed, the suction wheel risks taking up two sheets and transferring two sheets, also referred to as a double sheet, to the downstream machine for processing sheets. Another disturbance of the suction process is based on the fact that when the distance between the suction wheel and a top edge of the stack is too great, the instant at which the uppermost sheet is gripped by the suction wheel cannot be predetermined with a sufficient degree of accuracy. Conversely, if the distance between the suction wheel and the top edge of the stack is too small, a separating air cushion is difficult to create between the uppermost sheet and the sheet underneath the uppermost sheet because due to the short distance, hardly any separating air can be blown over a larger area underneath the sheet to be separated.

SUMMARY OF THE INVENTION

It is accordingly an object of the invention to provide a non-circular suction wheel and a sheet feeder which overcome the above-mentioned disadvantages of the prior art devices of this general type, in which the suction wheel securely engages a respective uppermost sheet in a stack in a defined way.

With the foregoing and other objects in view there is provided, in accordance with the invention a suction wheel. The suction wheel contains a suction wheel body rotatable about an axis of rotation and having a circumferential surface with a plurality of suction openings formed therein for attracting sheets by suction and for transporting the sheets. The suction wheel body is of a non-circular shape. The suction wheel body is divided into n segments of generally equal size, with n=1, 2, 3, 4 . . . . Each of the segments has an attraction area for attracting a sheet by suction, a retaining area for retaining and conveying the sheet, and a release area for releasing the sheet. The attraction area, the retaining area, and the release area are all different from each other.

In accordance with the invention, a suction wheel contains a suction wheel body rotatable about an axis of rotation and equipped with a plurality of suction openings distributed over its circumferential surface to attract sheets by suction and to transport them. In particular, the suction wheel is used to separate a respective uppermost sheet from a stack of sheets. The suction wheel body is advantageously configured to be non-circular. Therefore the radius of the suction wheel body is not constant over the entire suction wheel body. In other words, the distance between the axis of rotation of the suction wheel body and the circumferential or jacket surface of the suction wheel body varies. In contrast to a conventional circular suction wheel, the suction wheel of the invention advantageously provides a varying distance between the circumferential surface of the suction wheel body and an uppermost sheet to be engaged by the suction wheel during the rotary movement of the suction wheel body. Consequently, there are periods of time in which the distance is reduced and a sheet can easily be attracted by suction and periods of time in which the distance is greater to enable separating air to be blown between the uppermost sheet and the sheet underneath the uppermost sheet to create an air cushion between the two sheets. In the present disclosure, a suction wheel is understood to include a suction wheel with revolving belts in a device for removing sheets from a stack as described in German patent DE 196 32 657 C1 and published, non-prosecuted German patent application DE 196 48 742 A1.

The suction wheel body is advantageously subdivided into n segments of equal size, n being a natural number (n=1, 2, 3, 4 etc.). Each segment includes an attraction area for attracting a sheet by suction, a retaining area for retaining and conveying a sheet, and a release area for releasing the sheet. Due to the provision of segments that have different functions, the suction wheel of the invention may advantageously carry out the functions of a lifting and dragging suction element of the prior art although it is of much simpler construction. The attraction area, the retaining area, and the release area are different from each other, i.e. they are not identical.

In accordance with an advantageous embodiment of the suction wheel of the invention, the radius of the suction body in the attraction area is greater than the radius of the suction body in the retaining area. The greater radius of the suction body in the attraction area ensures that while a sheet is attracted by suction, the distance between the suction openings of the suction body and the sheet to be attracted is particularly small. This on the one hand ensures that the sheet is reliably attracted by suction and on the other hand that the instant at which a respective uppermost sheet is engaged by the suction wheel is predeterminable in a more accurate way. Due to the reduced radius of the suction body in the retaining area, the uppermost sheet that has been lifted is lifted further relative to the sheet underneath and separating air may be introduced between the sheets to form an air cushion.

In accordance with a preferred embodiment, the suction effect of the suction wheel in the release area is reduced compared to the suction effect in the attraction area and in the retaining area. For instance, in particular in the release area, there may be fewer suction openings per unit of area than in the attraction area and in the retaining area. In an extreme case, there may even be no suction openings in the release area of the suction body, or the suction openings may be at least partially masked or closed. Due to the reduced suction effect, a respective sheet is no longer held as strongly as before and may easily be released and transferred to a downstream transporting unit, for example.

In accordance with an advantageous embodiment of the suction wheel of the invention, the surface properties of the circumferential surface of the suction wheel body in the attraction area and/or in the retaining area and/or in the release area differ from each other. For instance, they may in particular have different coefficients of friction. This may be achieved by selecting different materials or by providing different surface treatments. For instance, the circumferential surface in the attraction area may be made of polyurethane (PU), the circumferential surface in the retaining area may be made of steel, and the circumferential surface in the release area may be made of a chromium-plated material. In accordance with a further advantageous feature the coefficient of friction of the circumferential surface portion in the release area may be lower than the coefficient of friction of the circumferential surface portion in the retaining area.

In accordance with an embodiment of the suction wheel, the circumferential surface portion of the suction wheel body in the attraction area is a flat surface. This advantageously provides an approximately constant distance between the entire attraction area and the uppermost sheet in a stack at the instant of attraction so that the sheet can be securely attracted by suction in a defined way.

A further object of the invention is to provide a sheet feeder for a machine for processing sheets wherein sheets are securely separated, arranged at a desired distance to each other, and fed to the machine for processing sheets.

In accordance with the invention, the object is attained by a sheet feeder. The sheet feeder is for a machine for processing sheets and is used to lift sheets off a stack of sheets and to separate them from the stack using at least one suction wheel as described above. The suction wheel is arranged above the stack and acts on a respective uppermost sheet in the stack.

The invention described above and the advantageous embodiments may be combined in any desired way to form further advantageous embodiments of the invention.

Other features which are considered as characteristic for the invention are set forth in the appended claims.

Although the invention is illustrated and described herein as embodied in a non-circular suction wheel and a sheet feeder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
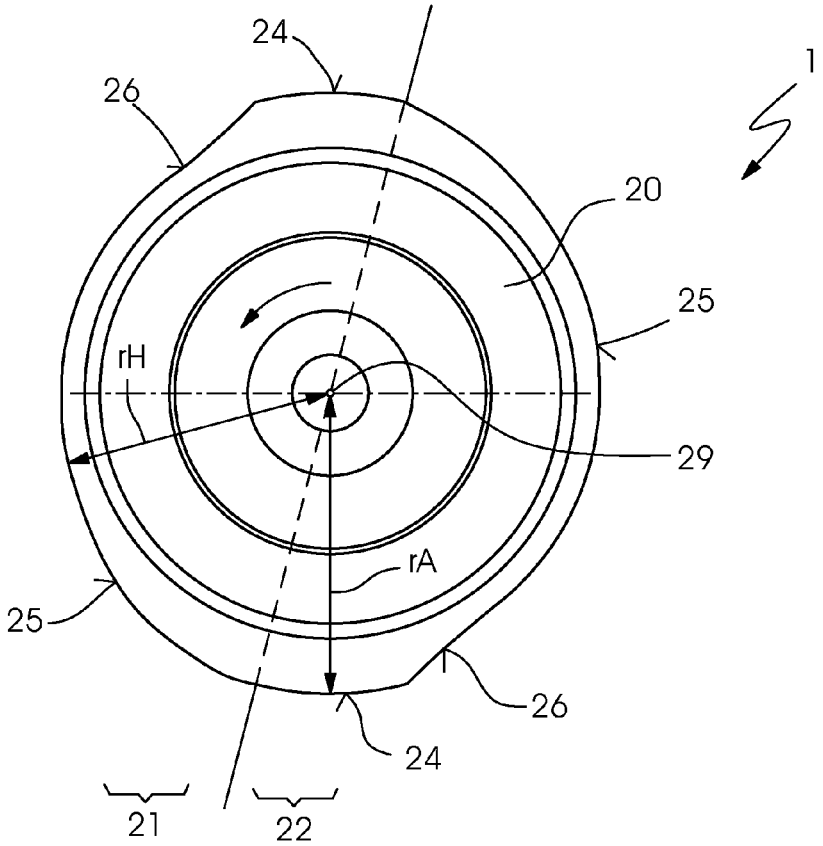
FIG. 1A is a diagrammatic, front view of a first embodiment of a suction wheel according to the invention.

In the figures, like elements and components are shapeated by like reference numerals.

Referring now to the figures of the drawing in detail and first, particularly, to FIG. 1A thereof, there is shown a first embodiment of a suction wheel 1 of the invention. The suction wheel 1 includes a suction wheel body 20 that is subdivided into a first segment 21 and a second segment 22. Each segment 21, 22 includes an attraction area 24, a retaining area 25, and a release area 26. The attraction area 24 acts to attract a sheet by suction. The retaining area 25 acts to retain the attracted sheet and to transport the sheet as the suction wheel 1 rotates. The release area 26 acts to release transported sheets to be able to transfer them to a downstream transport device, for example. The suction wheel body 20 of the suction wheel 1 is non-circular. Therefore the suction wheel body 20 does not have a uniform radius. Instead, a radius rA of the suction wheel body 20 in the attraction area 24 is greater than a radius rH in the retaining area 25. The transition between the smaller radius rH and the greater radius rA is continuous. During operation, the suction wheel 1 is supplied with suction air and rotates about an axis of rotation 29.

Figure 1B:
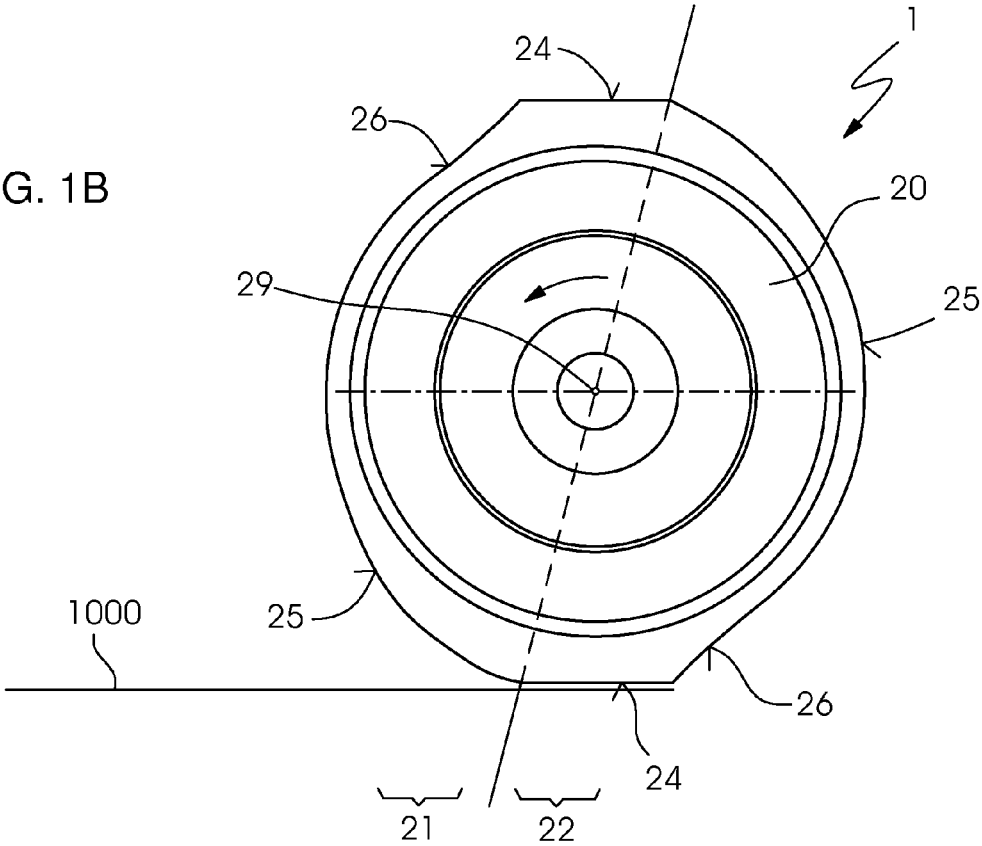
FIG. 1B is a front view of a second embodiment of the suction wheel.

FIG. 1B illustrates the suction wheel 1 whose suction wheel body 20 is of alternative design: a circumferential surface 28 portion (see FIG. 2A) of the suction wheel body 20 in the attraction area 24 is configured as a flat surface. A sheet 1000 located underneath the suction wheel 1 can thus be attracted in a particularly reliable way.

Figure 2A:
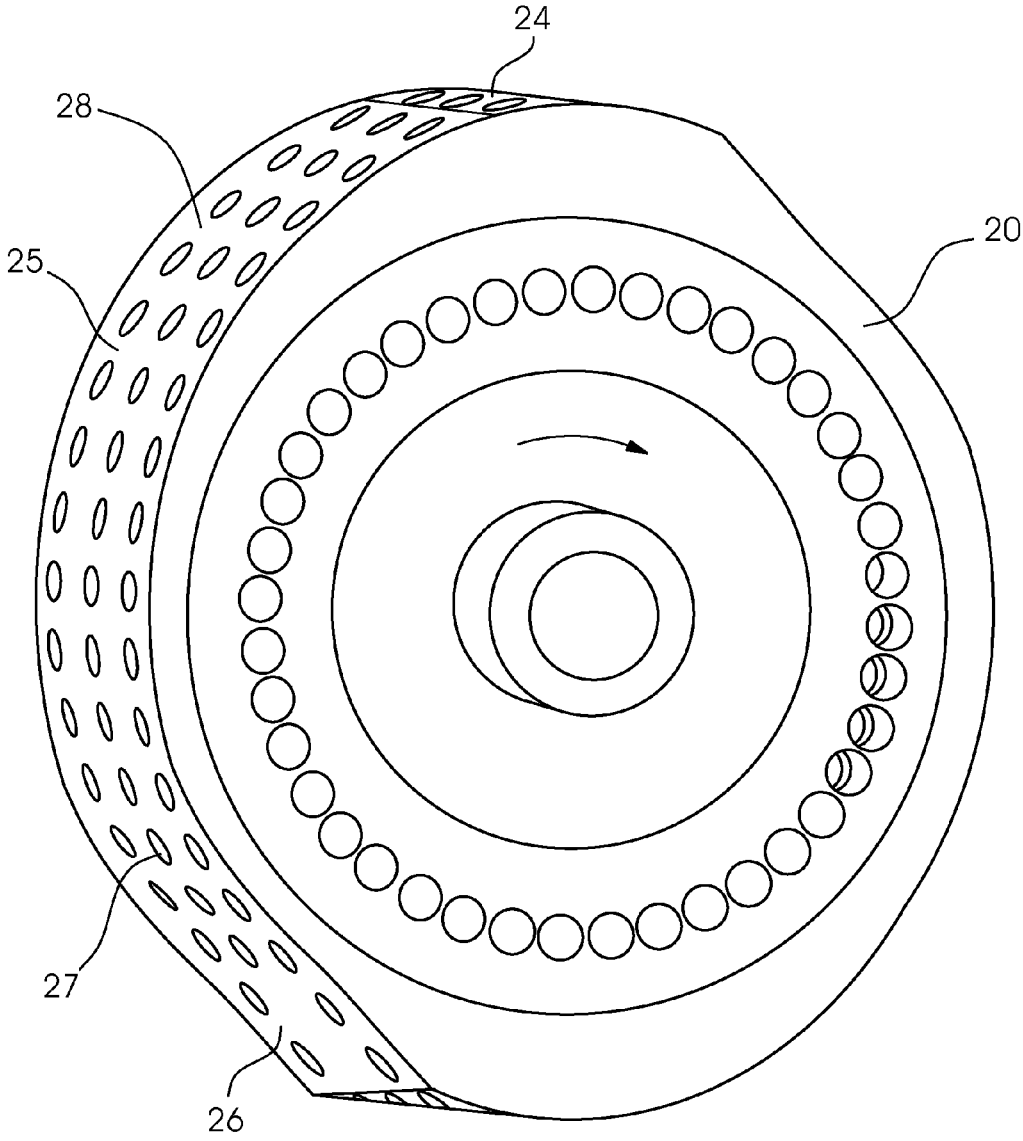
FIG. 2A is a perspective view of the suction wheel.
Figure 2B:
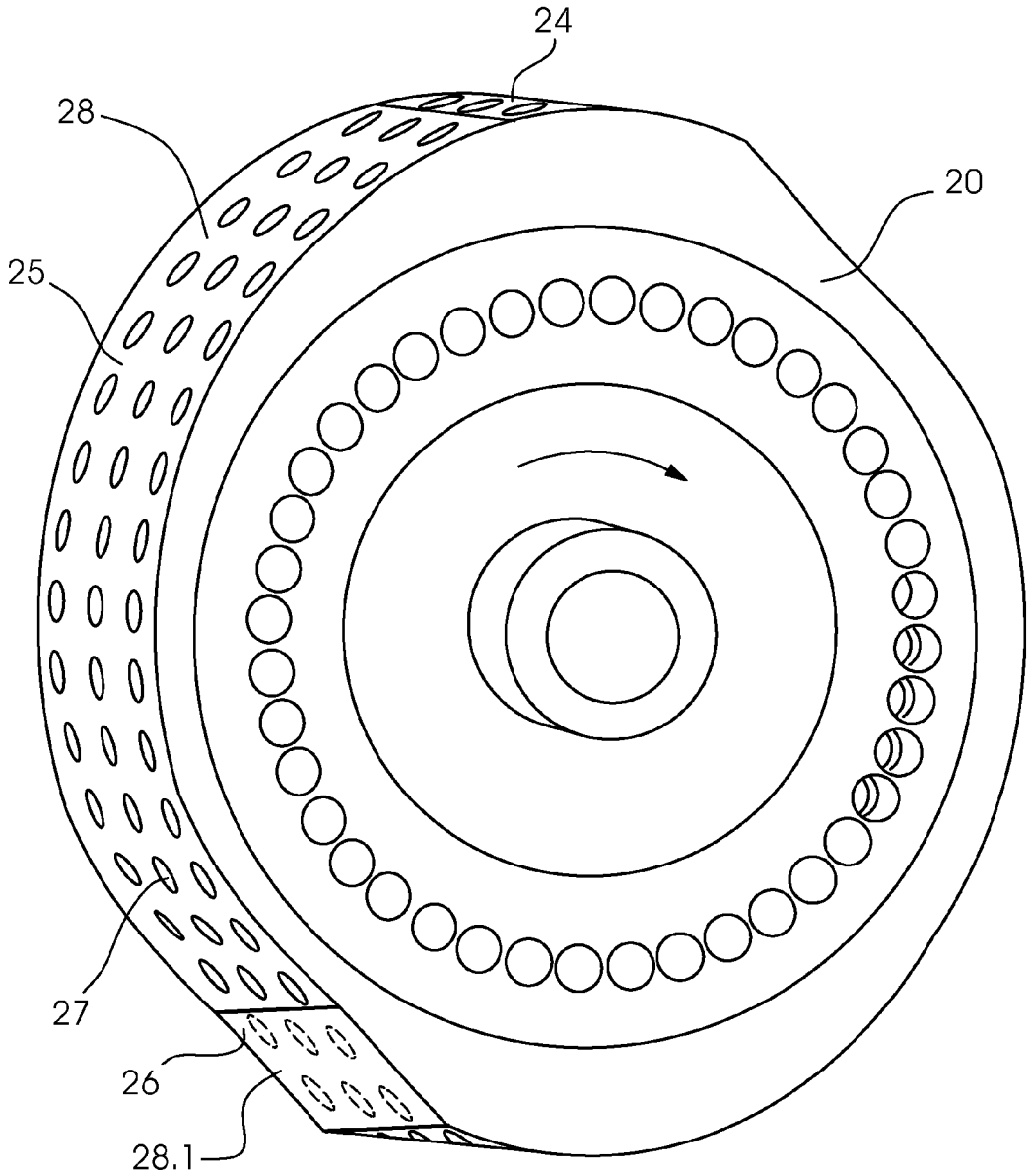
FIG. 2B is a perspective view of a further embodiment of the suction wheel.

As shown in FIG. 2A, the circumferential surface 28 of the suction wheel body is provided with suction openings 27 through which the suction air takes effect. The number of suction openings 27 per unit of area in the attraction area 24, in the retaining area 25, and in the release area 26 may be different. In the attraction area 24, a strong suction force is required because this is the area where the sheet 1000 is first attracted by suction by the suction wheel 1. In the retaining area 25, the suction force needs to be strong enough to retain and transport a respective sheet 1000 that has been attracted by suction in the attraction area 24. In the release area 26, less suction force is desired to simplify the release and transfer of a respective sheet 1000. Thus in the release area 26, the number of suction openings 27 per unit of area in the suction wheel body 20 is reduced compared to the retaining area 25 and the attraction area 24. Alternatively, the suction openings 27 may be closed or covered by laminating the circumferential surface portion 28.1 of the release area as shown in FIG. 2B and may thus be rendered ineffective.

Figure 3A:
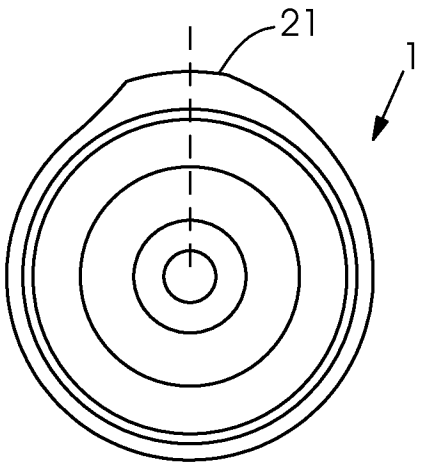
FIGS. 3A-3C are front views of the suction wheels having one, two and three segments, respectively.
Figure 3B:
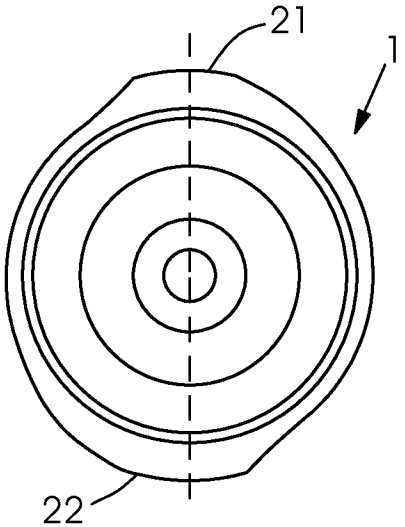
Figure 3C:
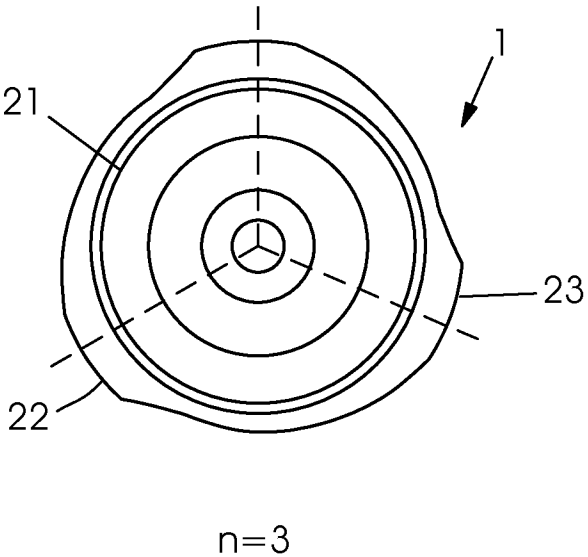

As an alternative to the embodiments of the suction wheel body 20 with two segments 21, 22 as shown in FIGS. 1A, 1B and 2A, 2B and 3B, the suction wheel body may comprise only one first segment 21, which includes the attraction area 24, the retaining area 25, and the release area 26 as shown in FIG. 3A. However, it is likewise possible for the suction wheel body 20 to have a larger number of segments 21, 22, 23, each of which likewise contains the attraction area 24, the retaining area 25, and the release area 26 as shown in FIG. 3C.

Figure 4:
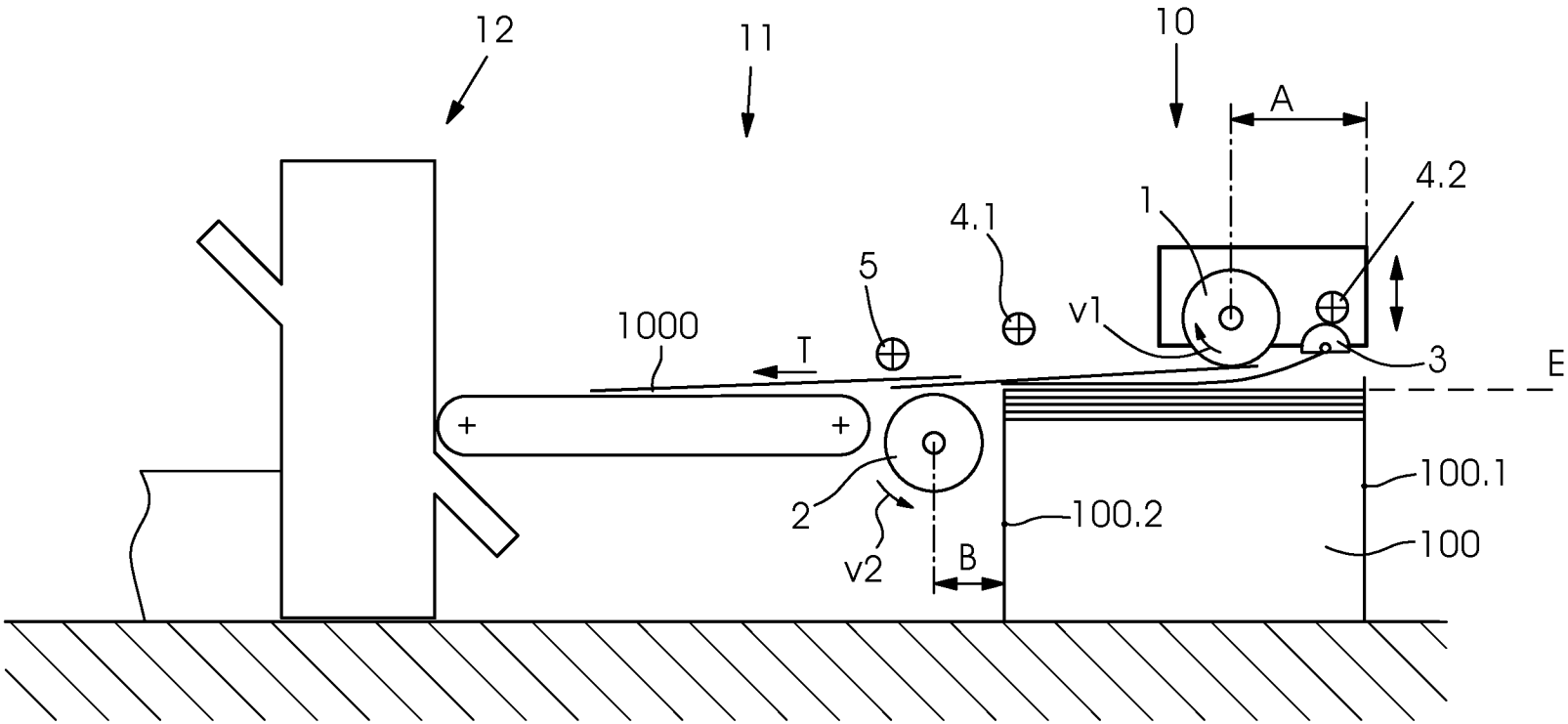
FIG. 4 is an illustration of a sheet feeder containing the suction wheel according to the invention.

FIG. 4 is a representation of a sheet feeder 10 that includes the suction wheel 1 of the invention for separating sheets 1000 from a stack 100 of sheets and for feeding the separated sheets 1000 over a feed table 11 to a machine 12 for processing sheets. The illustrated machine 12 for processing sheets is a buckle folding unit in a sheet-fed folder. To simplify the illustration, the suction wheel 1 is represented as a circle; however, it is to be understood that suction wheel 1 is of the advantageous design described above.

The sheet feeder 10 includes a first suction wheel 1 formed in accordance with the invention and a second suction wheel 2. The first suction wheel 1 is arranged above the stack 100 of sheets. The second suction wheel 2 is arranged below a plane E of sheet travel and downstream of the stack 100 as viewed in a direction of sheet travel T. The axis of rotation of the first suction wheel 1 is at a distance A from a rear edge 100.1 of the stack 100 of sheets. The second suction wheel 2 is arranged at a distance B from a front edge 100.2 of the stack 100 of sheets. The distance A is greater than or at least equal to distance B to ensure that an uppermost sheet 1000 in the stack 100 is gripped by the suction wheel 1 and reliably transferred to the second suction wheel 2 before a subsequent sheet 1000 is attracted by suction by the first suction wheel 1 and likewise transported by the latter. The sheet feeder 10 includes two height sensors 4.1 and 4.2, which are provided to indicate that the stack 100 needs to be lifted and to adapt the height of the unit consisting of the first suction wheel 1 and a lifting/separating unit 3. The lifting/separating unit 3 is arranged in the region of the rear edge 100.1 of the stack 100 of sheets and is used to lift a respective uppermost sheet 1000 off the sheet stack 100 to separate the uppermost sheet from the stack of sheets. A sensor 5 for detecting double or multiple sheets as well as the distance between individual sheets and/or the degree of overlap between the sheets is provided downstream of the second suction wheel 2. When the sensor 5 detects a fault, at this point the sheet 1000 in question may be discharged or its position in the stream of sheets may be corrected.

As indicated by the arrows of rotation, the first suction wheel 1 is rotated at a rotational speed v1 and the second suction wheel 2 is rotated at a rotational speed v2. The rotational speed v1 is always lower or at least equal to the rotational speed v2. That is to say that the first suction wheel 1 attracts the sheet 1000 by suction and transports it at the lower rotational speed v1 to ensure greater accuracy and less danger of damage to the sheet 1000. Then the sheet 1000 is significantly accelerated due to the significantly higher rotational speed v2 of the second suction wheel 2. Advantageously, the second suction wheel 2 may accelerate the sheet 1000 up to the production speed of the folding unit 12.

Figures 5A, 5B, 5C, 5D:
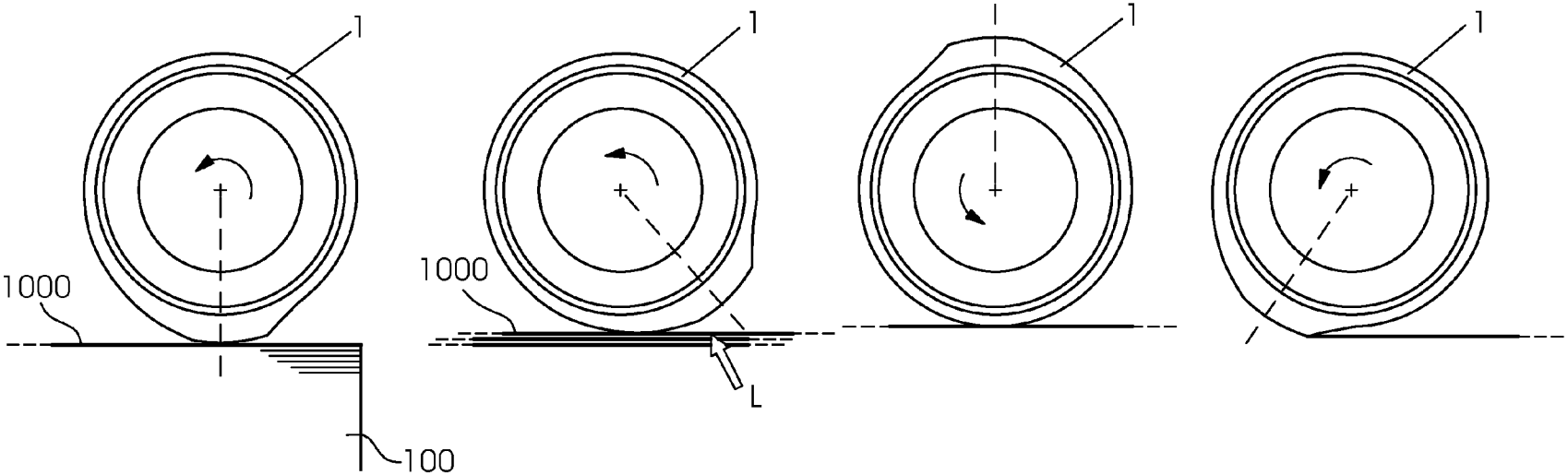
FIGS. 5A-5D are front views illustrating a sequence of operations in the process of attracting and transporting a sheet using the suction wheel according to the invention.

The mode of action of the non-circular suction wheel 1 becomes apparent from FIGS. 5A to 5D in connection with the figures described above. FIG. 5A illustrates the process of attracting the sheet 1000 by suction. The sheet 1000 is attracted by suction by the attraction area 24 of the suction wheel 1. Due to the greater radius rA in the attraction area 24, the distance to an uppermost sheet 1000 in a stack 100 of sheets is at a minimum and the uppermost sheet 1000 may be securely attracted by suction in a defined way. As the suction wheel 1 rotates, as shown in FIGS. 5B and 5C, the sheet that has been attracted by suction is retained and transported in the retaining area 25 of the suction wheel body 20. Due to the smaller radius rH in the retaining area 25, the sheet 1000 that has been attracted by suction is slightly lifted off the stack 100 of sheets so that the sheet underneath, which has likewise been lifted, may likewise be lifted further to allow separating air L to be blown between the lifted sheet 1000 and the sheet 1000 underneath still on the stack 100 to create a separating air cushion between the two sheets. Before a next sheet may be attracted by suction and transported by the suction wheel 1, the sheet 1000 is subject to reduced suction in the release area 26 as shown in FIG. 5D, so that it may easily be released and transferred to a downstream transport device, for example. As shown in FIG. 4, the downstream transport device may likewise be a suction wheel, namely a second suction wheel embodied in accordance with the prior art and arranged below the plane of sheet travel.

Figure 6:
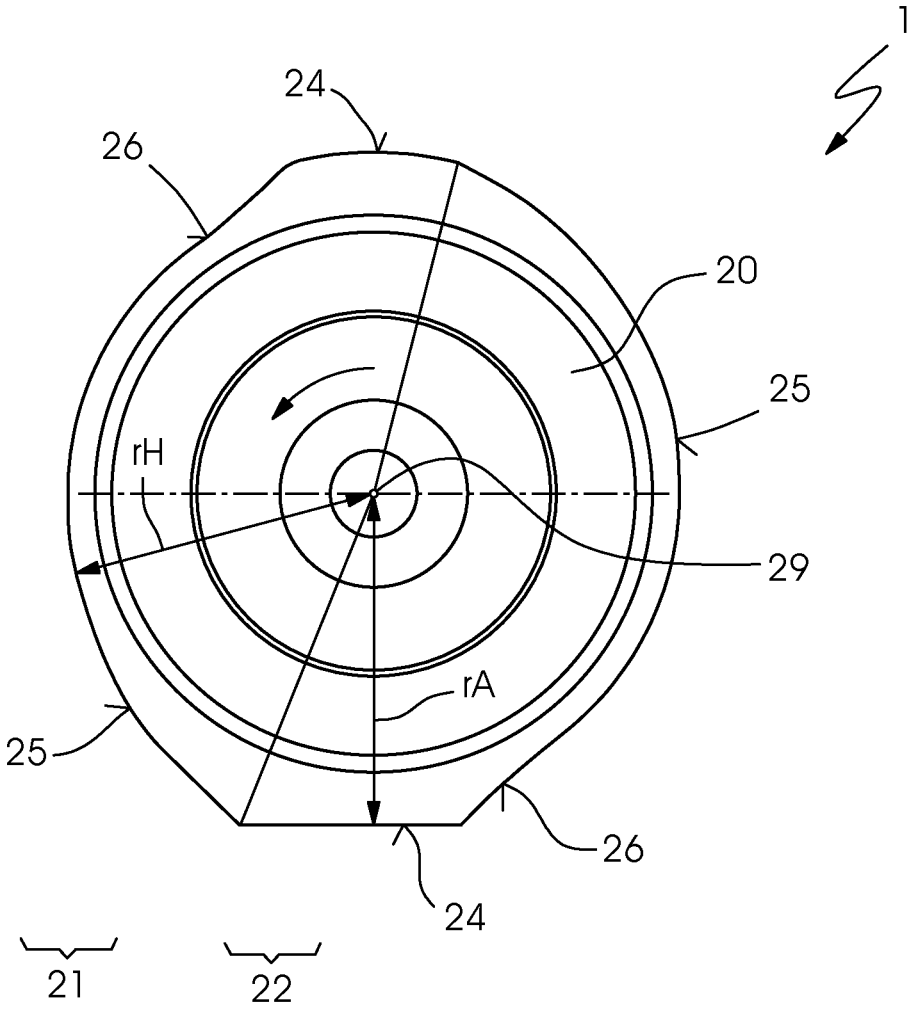
FIG. 6 is a front view of an alternative design of the suction wheel.

FIG. 6 illustrates an alternative design of the suction wheel 1. Again the suction wheel consists of a plurality m of elements 21, 22, which may differ from each other and need not have the same design in particular in terms of their geometry and material. A respective element 21, 22 is formed by a body segment. The various body segments may be assembled to form the suction wheel 1. This advantageously allows the suction wheel 1 to be customized in terms of its specific functions and in terms of the requirements of a job (e.g. the weight of the sheets to be processed). This customization may be made by the operator of the machine.

The fact that the radius of the non-circular suction wheel varies allows the provision of multiple separate areas also referred to as segments.

The individual areas may be used to control the vacuum by providing suction holes of different designs in the different areas, by varying the number of suction holes, or by completely closing off the suction holes, for example by laminating them.

A characteristic of the attraction area is that the distance between the suction wheel and the stack of sheets is short (e.g. less than 4 mm) and may thus have optimum dimensions. Due to the rotary movement of the non-circular suction wheel and the entrainment of the sheet, the attraction area moves on and the separation air area, which has a reduced radius, lifts the sheet at the same time as it conveys the sheet onward. The attraction of the sheets underneath is optimized in the starting phase and an undesired entrainment of a second sheet is avoided. The separating air may be blown through between the sheet attracted by the suction wheel and the surface of the stack without impediment so that an air cushion may form between the uppermost sheet and the sheet underneath.

The different segments will be described below.

Attraction Area:

The distance between the suction wheel and the stack of sheets is optimized in terms of the attraction of sheets by suction and may range between 1 and 5 mm, for example.

Due to the short distance, the attraction area of the suction wheel reliably attracts a sheet to be conveyed.

Retaining and Separation Air Area:

The distance between the suction wheel and the stack of sheets is optimized in terms of the separation air process and ranges between 10 and 15 mm, for example.

Thus the sheet to be conveyed is at a distance of 10-15 mm to the surface of the stack and to the following sheet.

Since the distance between the suction wheel/sheet and the surface of the stack has been increased by approximately 10 mm, the sheet underneath may be separated from the stack and prepared to be conveyed in an optimum way.

Release and Transfer Area:

The suction zone area is optimized in terms of a defined transfer of the sheet from the non-circular suction wheel to the transport element. Depending on the requirements, the design of the suction zone and the suction effect may be adapted to the downstream conveying system, i.e. to the effect of the second suction wheel, for example. It is possible to reduce the vacuum and to modify the shape and properties of the material of the circumferential surface.

The individual areas may be distributed about the circumference n times. For example, each area may be provided once (see FIG. 3A), twice (see FIG. 3B) or three times (see FIG. 3C).

List of Reference Symbols

1 first suction wheel
2 second suction wheel
3 lifting/separation unit
4.1 height sensor
4.2 height sensor
5 sensor
10 sheet feeder
11 feed table
12 folding unit (machine for processing sheets)
20 suction wheel body
21 first segment
22 second segment
23 third segment
24 attraction area
25 retaining area
26 release area
27 suction opening
28 circumferential surface of the suction wheel body
28.1 circumferential surface of the release area
29 axis of rotation
100 stack of sheets
100.1 rear edge of the stack
100.2 front edge of the stack
1000 sheet
rA radius of the attraction area
rH radius of the retaining area
v1 rotational speed of the first suction wheel
v2 rotational speed of the second suction wheel
A distance of the first suction wheel
B distance of the second suction wheel
E plane of sheet travel
L blown air for separation purposes
T direction of transport

The invention claimed is:

1. A suction wheel, comprising:

a suction wheel body rotatable about an axis of rotation and having a circumferential surface with a plurality of suction openings formed therein for attracting sheets by suction and for transporting the sheets, said suction wheel body being of a non-circular shape, said suction wheel body having at least one segment, said at least one segment including an attraction area for attracting a sheet by suction, a retaining area for retaining and conveying the sheet by suction, and a release area for releasing the sheet, and said attraction area, said retaining area, and said release area being different from each other, said suction openings formed at least in said attraction area and said retaining area.

2. The suction wheel according to claim 1, wherein a first radius of said suction wheel body in said attraction area is greater than a second radius of said suction wheel body in said retaining area.

3. The suction wheel according to claim 1, wherein a suction effect of the suction wheel in said release area is weaker than in said attraction area and in said retaining area, wherein in said release area, said suction wheel body has fewer said suction openings per unit of area than in said attraction area and in said retaining area.

4. The suction wheel according to claim 1, wherein said circumferential surface of said suction wheel body has different surface properties in said attraction area, in said retaining area and in said release area.

5. The suction wheel according to claim 4, wherein a coefficient of static friction of a portion of said circumferential surface in said release area is lower than the coefficient of static friction of at least a portion of said circumferential surface in said retaining area.

6. The suction wheel according to claim 4, wherein said different surface properties are coefficients of friction.

7. The suction wheel according to claim 1, wherein a portion of said circumferential surface of said suction wheel body in said attraction area is a flat surface.

8. A sheet feeder for a machine for processing sheets, for lifting the sheets off a stack and for separating the sheets from the stack, the sheet feeder comprising:

at least one suction wheel containing a suction wheel body rotatable about an axis of rotation and having a circumferential surface with a plurality of suction openings formed therein for attracting the sheets by suction and for transporting the sheets, said suction wheel body being of a non-circular shape, said suction wheel body having at least one segment, the at least one segment including an attraction area for attracting a sheet by suction, a retaining area for retaining and conveying the sheet by suction, and a release area for releasing the sheet, and said attraction area, said retaining area, and said release area being different from each other, wherein said suction wheel disposed above the stack and acts on a respective uppermost sheet in the stack, the suction openings formed at least in the attraction area and the retaining area.

9. A suction wheel, comprising:

a suction wheel body rotatable about an axis of rotation and having a circumferential surface with a plurality of suction openings formed therein for attracting sheets by suction and for transporting the sheets, said suction wheel body being of a non-circular shape, said suction wheel body having at least one segment, said at least one segment including an attraction area for attracting a sheet by suction, a retaining area for retaining and conveying the sheet by suction, and a release area for releasing the sheet, and said attraction area, said retaining area, and said release area being different from each other, wherein a first radius of said suction wheel body in said attraction area is greater than a second radius of said suction wheel body in said retaining area.

10. A sheet feeder for a machine for processing sheets, for lifting the sheets off a stack and for separating the sheets from the stack, the sheet feeder comprising:

at least one suction wheel containing a suction wheel body rotatable about an axis of rotation and having a circumferential surface with a plurality of suction openings formed therein for attracting the sheets by suction and for transporting the sheets, said suction wheel body being of a non-circular shape, said suction wheel body having at least one segment, said at least one segment including an attraction area for attracting a sheet by suction, a retaining area for retaining and conveying the sheet by suction, and a release area for releasing the sheet, and said attraction area, said retaining area, and said release area being different from each other, wherein said suction wheel disposed above the stack and acts on a respective uppermost sheet in the stack, wherein a first radius of said suction wheel body in said attraction area is greater than a second radius of said suction wheel body in said retaining area.

* * * * *